United States Patent [19]

Clading-Boel

[11] Patent Number: 4,500,222

[45] Date of Patent: Feb. 19, 1985

[54] AQUEOUS INK WRITING TIP

[75] Inventor: John P. Clading-Boel, Enfield, England

[73] Assignee: Waite & Son Limited, Mitcham, England

[21] Appl. No.: 56,230

[22] Filed: Jul. 10, 1979

[30] Foreign Application Priority Data

Jul. 11, 1978 [GB] United Kingdom ..... 29444/78
Sep. 11, 1978 [GB] United Kingdom ..... 36371/78

[51] Int. Cl.[3] ..... B43K 7/10; B43K 8/02

[52] U.S. Cl. ..... 401/209; 401/198; 401/216

[58] Field of Search ..... 401/199, 219, 233, 198, 401/209–217

[56] References Cited

U.S. PATENT DOCUMENTS

| | | | |
|---|---|---|---|
| 3,361,516 | 1/1968 | Rigondaud | 401/198 X |
| 3,572,954 | 3/1971 | Cheron | 401/199 X |
| 3,966,336 | 6/1976 | Lotfallah | 401/199 X |
| 4,145,148 | 3/1979 | Fukuoka | 401/209 |

FOREIGN PATENT DOCUMENTS

| | | | |
|---|---|---|---|
| 553008 | 1/1960 | Belgium | 401/216 |
| 2319942 | 10/1974 | Fed. Rep. of Germany | 401/199 |
| 2743888 | 4/1979 | Fed. Rep. of Germany | 401/216 |
| 2854604 | 6/1979 | Fed. Rep. of Germany | 401/216 |
| 965870 | 9/1950 | France | 401/216 |
| 1509356 | 1/1968 | France | 401/209 |
| 4945624 | 7/1974 | Japan . | |
| 814734 | 6/1959 | United Kingdom | 401/216 |
| 948431 | 2/1964 | United Kingdom | 401/223 |
| 1139038 | 1/1969 | United Kingdom | 401/216 |
| 1179979 | 2/1970 | United Kingdom | 401/209 |

*Primary Examiner*—Steven A. Bratlie
*Attorney, Agent, or Firm*—Scrivener, Clarke, Scrivener and Johnson

[57] ABSTRACT

A writing tip 1 for use with aqueous ink comprises an elongate housing 2. A writing ball 3 is retained in a socket 4 at one end 5 of the housing and a fibrous feed core 6 having aqueous ink feeding capillaries extends into a bore 7 in the housing from the other end 8. The core 6 acts to transfer aqueous ink from a source to the ball via a grooved feed passage 9 between the bore 7 and socket 4 and in order to provide releasable transfer of ink between the core 6 and the passage 9, the core is inserted into the end 13 of the passage, the material of the core being substantially uncompressed within the grooves 12 of the passage 9 and assuming substantially the cross-section of the passage at least at the end 13.

6 Claims, 5 Drawing Figures

AQUEOUS INK WRITING TIP

This invention relates to writing tips for aqueous ink.

Writing tips for use with aqueous ink comprising an elongate housing, a ball retained in a socket at one end of the housing, and a fibrous feed core having aqueous ink feeding capillaries extending into a bore of the housing from the other end thereof for transferring aqueous ink from a source thereof to the ball via a grooved feed passage in the housing between the bore and the socket are known.

In these known tips the core is intended to be located in abutting relationship with the end of the grooved feed passage remote from the ball and ink transfer to the ball is often unreliable, primarily because of poor transfer of ink from the core to the grooves of the grooved feed passage, for example, due to an axial gap between the ends of the core and grooved feed passage intended to be in abutting relationship.

An object of the present invention is to provide a writing tip for aqueous ink which provides a more reliable ink transfer from the core to the grooved feed passage.

According to the present invention there is provided a writing tip for use with aqueous ink comprising an elongate housing, a ball retained in a socket at one end of the housing, and a fibrous feed core having aqueous ink feeding capillaries extending into a bore of the housing from the other end thereof for transferring aqueous ink from a source thereof to the ball via a grooved feed passage in the housing between the bore and the socket, wherein the feed core is inserted into the end of the grooved feed passage remote from the ball, the material of the core being substantially uncompressed within the grooves of the grooved feed passage and assuming substantially the cross-section of the grooved feed passage at least at said end thereof.

It will be appreciated that insertion of the core into the grooved feed passage in the manner defined above provides positive contact between the core and the grooves of the grooved feed passage making the transfer of ink therebetween more reliable.

In one embodiment of the invention described hereinafter the material of the core is substantially uncompressed within and adjacent the grooved feed passage.

It is particularly important that the core material within the grooves of the grooved feed passage should not be subjected to compression which would hinder the working of the capillaries of the core and advantageously the core and housing are arranged such that on insertion of the core into the grooved feed passage, material of the core is displaced without significant compression into the grooves of the feed passage, and advantageously also adjacent said end of the grooved feed passage.

In order that the invention may be well understood two embodiments thereof, which are given by way of example only, will now be described, reference being had to the accompanying drawings, in which.

Figure 1:
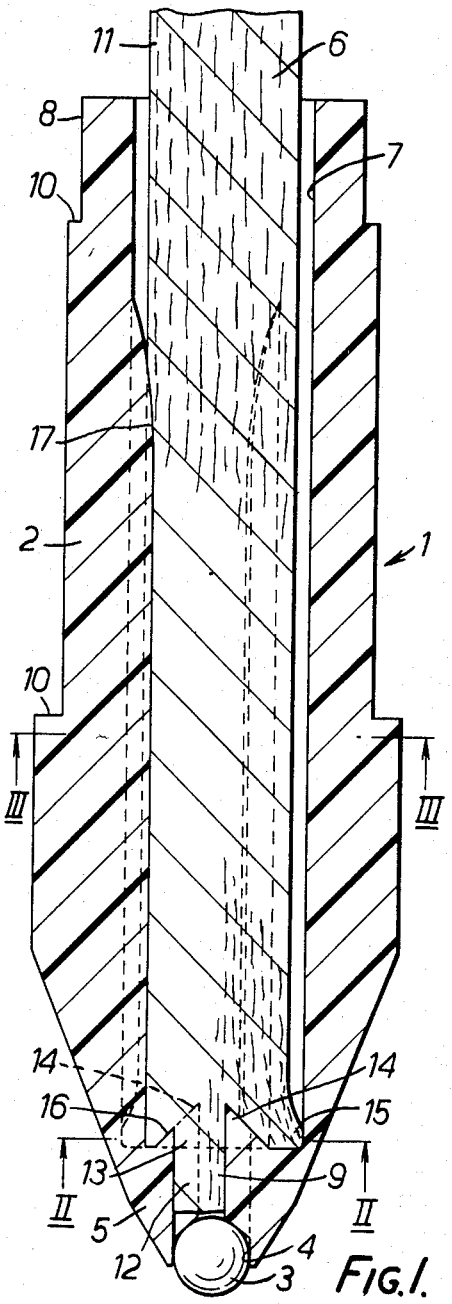
FIG. 1 is an axial section of a writing tip.

Each of the illustrated writing tips 1 is for use with aqueous ink and comprises an elongate housing 2, a writing ball 3 retained in a socket 4 at one end 5 of the housing and a feed core 6 extending into a bore 7 in the housing from the other end 8 thereof for transferring ink from a source thereof (not shown) to the ball 3 via a grooved feed passage 9 between the bore 7 and the socket 4. The housing is also provided with an annular abutment 10 by which it can be located in a writing instrument.

The core 6 is formed as a stick of longitudinally extending man-made fibres which are bonded together with a resin to provide aqueous ink feeding capillaries for feeding ink to the grooved passage 9 from the ink source, for example a transorbe or reservoir in a writing instrument into which end portion 11 of the core extends in use.

The grooved passage 9 illustrated has axially extending, circumferentially spaced grooves 12 which are capable of providing a capillary feed.

To provide good transfer of ink between the core 6 and passage 9, the core 6 is inserted into the end 13 of the passage 9 remote from the ball 3. The material of the core is substantially uncompressed within the grooves 12 of the feed passage 9 and assumes substantially the cross-section of the grooved feed passage 9 at least at the end 13 thereof (see FIGS. 2 and 4). Thus, good contact between the core and the grooves 12 of the passage 9 is achieved without significant compression of the core material which would hinder the working of the capillaries of the core.

In both the illustrated tips, this is achieved by arranging the core and housing such that on insertion of the core 6 into the passage 9 material of the core is displaced without significant compression into the grooves 12 of the feed passage 9.

Figure 2:
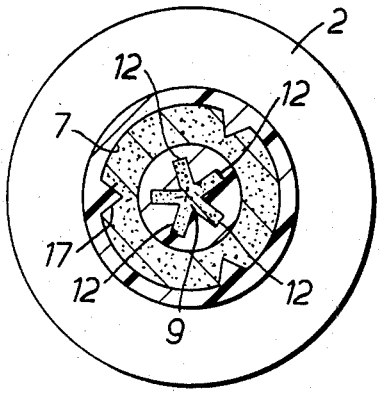
FIGS. 2 and 3 are respectively radial sections of the tip taken along the lines II—II and III—III of FIG. 1.
Figure 3:
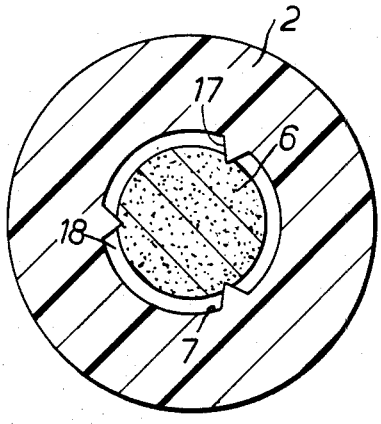

In the writing tip shown in FIGS. 1 to 3, the material of the core is substantially uncompressed within the grooved feed bore 9-not just the grooves 12 thereof—and also adjacent the grooved feed bore 9. The housing is injection moulded in plastics, and the end 13 of the passage 9 is formed with a plurality of projections 14 which extend away from the ball 3 and shear the material of the core as it is inserted into the passage 9 to displace some of the material which would otherwise have to enter the passage—and thereby cause compression of the material in the passage—into a region 15 of the bore adjacent the passage end 13. The end 13 of the passage is formed with a substantially frustoconical face 16 which is broken by the grooves 12 to provide radially outer surfaces of the projections 14 along which the displaced material is guided to the region 15. The grooves 12 are interconnected by knife-edges which assist displacement of the core material without significant compression thereof into the grooves.

The bore 7 is provided with longitudinal ribs 17 which radially locate and axially retain the core within the bore. The ribs 17, which are knife-edged and cut into the core, as illustrated in FIG. 3, serve to centre the core as it is being inserted into the passage 9 and thereafter secure the core in the bore 7. The periphery of the core is sheared by the knife-edges of the ribs 17 prior to insertion of the core into the passage 9 and this facilitates the subsequent shearing of the core by the projections 14.

Between the ribs 17, grooves 18 are defined and provide the accommodation in the region 15 of the bore 13 for the displaced core material, so that that material is not significantly compressed, or does not compress the material radially inwardly of it, and thereby hinder the capillary action of the core.

In the writing tip shown in FIGS. 1 to 3, the end portion of the core which is inserted into the passage 9 prior to such insertion is of the same diameter as the main portion of the core in the bore 7 and has a flat, radial end face. However, this end portion could be of reduced cross-section or tapered.

Figure 4:
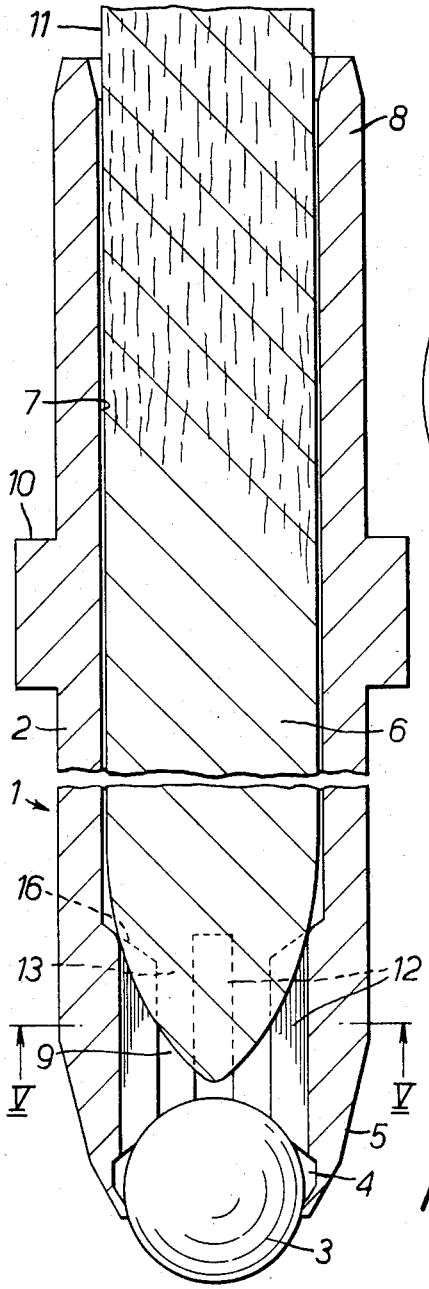
FIG. 4 is an axial section of another writing tip.
Figure 5:
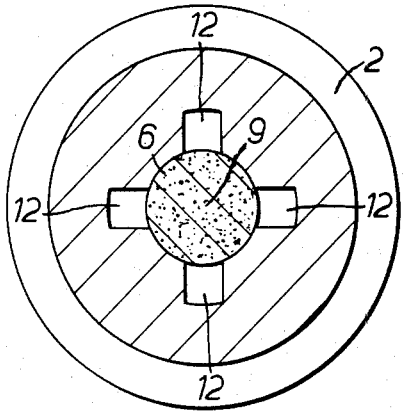
FIG. 5 is a radial section taken along the line V—V of FIG. 4.

In the writing tip shown in FIGS. 4 and 5, the end portion of the core 6 which is inserted into the passage 9 is pointed. This facilitates insertion of the core into the passage because it acts to centre the core and also because there is less material to be displaced into the grooves 12. The housing 2 in the writing tip shown in FIGS. 4 and 5 is formed of metal. Whilst the ribs 17 and projections 14 of the housing of the first-described housing could be provided they have been omitted. Nevertheless, in the tip illustrated in FIGS. 4 and 5, the material of the core is substantially uncompressed within at least the grooves 12 of the passage.

It will be noted that the end 13 of the passage is provided with a frusto-conical face 16 which extends oppositely to the face 16 of the housing of the first-described housing. Thus in both housings the end 13 of the passage is not formed with a planar radial face such as provided in the known tips in which abutment between the core end and the passage end is required. A planar radial face at the end 13 of the passage 9 would hinder insertion of the core into the passage and inevitably cause compression of the core within the grooves 12 of the passage, which compression would hinder the capillary action of the core 6.

I claim:

1. A writing tip for use with aqueous ink comprising an elongate housing; a socket at one end of the housing; a ball retained in the socket; a bore extending from the other end of the housing towards the socket; a feed passage in the housing between the bore and the socket, said feed passage comprising a central channel and a plurality of grooves extending radially outwardly from the channel and between the bore and socket; and a feed core comprising fibrous material defining aqueous ink feeding capillaries extending into the housing at the other end thereof, through said bore and into the feed passage at the end thereof remote from the socket, which end of the feed passage is formed with a plurality of projections which extend into said bore and shear the material of the core as it is inserted into the feed passage to displace material not aligned with said passage into a region of the bore adjacent said end of the passage whereby the material of the core within the feed passage is substantially uncompressed.

2. A writing tip for use with aqueous ink comprising an elongate housing; a socket at one end of the housing; a ball retained in the socket; a bore in the housing extending from the other end of the housing towards the socket; a feed passage in the housing between the bore and the socket, which feed passage comprises a central channel and a plurality of grooves extending radially outwardly from the channel between the bore and the socket; and a feed core of fibrous material defining aqueous ink feeding capillaries extending into the housing at the other end thereof, through said bore and into the end of the feed passage remote from the socket, said end being non-planar and formed with a plurality of projections which extend away from said ball and shear the material of the core as it is inserted into said passage to displace some of the material, which would otherwise have to enter the passage, into a region of the bore adjacent said end of the passage, the displaced material and the material within the grooves being substantially uncompressed and said material substantially filling said grooves at least at said end of said feed passage remote from said socket.

3. A writing tip for use with aqueous ink comprising an elongate housing; a socket at one end of the housing; a ball retained in the socket; a bore in the housing extending from the other end of the housing towards the socket; a feed passage in the housing between the bore and the socket, which feed passage comprises a central channel and a plurality of grooves extending radially outwardly from the channel between the bore and the socket; and a feed core of fibrous material defining aqueous ink feeding capillaries extending into the housing at the other end thereof, through said bore and into the end of the feed passage remote from the socket, said end being non-planar and formed with a plurality of projections which extend away from said ball and shear the material of the core as it is inserted into said passage to displace some of the material, which would otherwise have to enter the passage, into a region of the bore adjacent said end of the passage, the displaced material, the material within the grooves, within and adjacent the feed passage, and within the bore adjacent said end of the feed passage, being substantially uncompressed, and said material substantially filling said grooves at least at said end of said feed passage remote from said socket.

4. A tip as claimed in claim 4 wherein the non-planar end of the passage into which the core is inserted is defined by a substantially frusto-conical face which is broken by the grooves of said feed passage to provide the radially outer surfaces of said projections.

5. A tip as claimed in claim 1, 2 or 3 wherein said bore is provided with longitudinal ribs which radially locate and axially retain the core within the bore and define grooves for accommodating material of the core displaced thereinto during insertion of the core into said feed passage.

6. A tip as claimed in claim 5 wherein the ribs are knife-edged and cut into the core.

* * * * *